US005191863A

United States Patent [19]

Hagiwara

[11] Patent Number: 5,191,863

[45] Date of Patent: Mar. 9, 1993

[54] ROTARY SLEEVE-VALVE INTERNAL COMBUSTION ENGINE

[75] Inventor: Akira Hagiwara, Sagamihara, Japan

[73] Assignee: Oshima Construction Co., Ltd., Kanagawa, Japan

[21] Appl. No.: 761,750

[22] PCT Filed: Dec. 1, 1989

[86] PCT No.: PCT/JP89/01211

§ 371 Date: Sep. 17, 1991

§ 102(e) Date: Sep. 17, 1991

[87] PCT Pub. No.: WO90/11432

PCT Pub. Date: Apr. 10, 1990

[30] Foreign Application Priority Data

Mar. 24, 1989 [JP] Japan ..... 1-70394
May 17, 1989 [JP] Japan ..... 1-121485
Aug. 29, 1989 [JP] Japan ..... 1-220314

[51] Int. Cl.[5] ..... F02B 75/20

[52] U.S. Cl. ..... 123/59 AC; 123/65 VA; 123/78 A; 123/51 B

[58] Field of Search ..... 123/59 AC, 65 VA, 188 C, 123/48 R, 48 AA, 78 R, 78 A, 51 R, 51 B, 51 BA, 52 A, 80 C

[56] References Cited

U.S. PATENT DOCUMENTS 1,073,640 9/1913 Smith ..... 123/59 AC
1,121,682 12/1914 Snell ..... 123/59 AC
1,172,940 2/1916 Cleaver ..... 123/59 AC
1,838,308 12/1931 Higman ..... 123/65 VA
2,781,748 2/1957 Stucke ..... 123/65 VA
2,855,912 10/1958 Stucke ..... 123/59 AC
2,982,272 5/1961 Stucke ..... 123/59 AC
5,081,963 1/1992 Galbraith ..... 123/59 AC

FOREIGN PATENT DOCUMENTS 615132 12/1926 France .
710242 8/1931 France .
14-6239 12/1939 Japan .
17-806 2/1942 Japan .
23-973 7/1948 Japan .
48-29911 4/1973 Japan .
51-41118 4/1976 Japan .
62-265411 11/1987 Japan .
56159519 12/1991 Japan .
2129488A 5/1984 United Kingdom .

OTHER PUBLICATIONS

Abstract of Japanese Publication No. 56-159519; Date: Dec. 8, 1981; Title: Engine with Two Piston in One Cylinder.

Abstract of Japanese Publication No. 62-265411; Date: Nove. 18, 1987; Title: Rotary Valve Type Four Cycle Engine.

*Primary Examiner*—David A. Okonsky

*Attorney, Agent, or Firm*—Armstrong, Nikaido, Marmelstein, Kubovcik & Murray

[57] ABSTRACT

The present invention is an internal combustion engine having a rotary sleeve valve mechanism with a sleeve valve which has an opening formed in the outer peripheral surface for suction of fuel and discharge of exhaust gas. The present invention achieves an improvement in the admission and exhaust efficiency and simplification of the valve mechanism by employing a rotating sleeve valve. The rotary sleeve-valve internal combustion engine has a cylindrical rotary cylinder valve (3) which is rotatably supported in an engine block (1). An opening (5) which is provided in the outer peripheral wall surface of the rotary cylinder valve (3) provides communication with an inlet port (10) during admission and with an exhaust port (15) during exhaust. A seal ring (40) is provided around the periphery of the opening (5) to effect gas seal for the area between the engine block (1) and the inner peripheral wall surface (7). A gear (4) that is provided on one end of the rotary cylinder valve (3) is in mesh with a crank gear (26) provided on a crankshaft (20). The rotation of the crankshaft (20) and that of the rotary cylinder valve (3) are interlocked with each other to effect admission and exhaust synchronously.

13 Claims, 11 Drawing Sheets (a)

(b)

(c)

(d)

(a)

(b)

(b)

(a)

ROTARY SLEEVE-VALVE INTERNAL COMBUSTION ENGINE

DESCRIPTION

1. Technical Field

The present invention relates to an internal combustion engine. More particularly, the present invention relates to an internal combustion engine having a rotary sleeve valve mechanism with a sleeve valve which is formed with an opening in the outer peripheral surface for suction of fuel and discharge of exhaust gas.

2. Background Art

In an internal combustion engine of the type in which a piston performs reciprocating motion, a mixture of fuel and air is sucked into a cylinder chamber from an inlet valve and this mixture is compressed and explosively burned, and the exhaust gas after the explosive combustion is discharged from an exhaust valve by moving the piston in the cylinder.

In the meantime, valve mechanisms for admission and exhaust of the fuel mixture may be roughly divided into three, that is, poppet valve mechanism, sleeve valve mechanism, and rotary valve mechanism. The poppet valve mechanism, which is widely used in internal combustion engines, comprises generally a valve gear and a driving gear therefor. The valve gear has a cam for controlling the opening and closing of the valve, a transmission mechanism for transmitting the motion of the cam, and a mechanism for converting the cam motion into motion for opening and closing the valve. The driving gear is a mechanism for driving the cam shaft in synchronism with the rotation of the crankshaft.

At present, several different types of poppet valve mechanism are commercially employed depending on the performance characteristics of the engine, the configuration of the combustion chamber, the readiness of maintenance, the production cost, etc. These poppet valve mechanisms may be roughly divided into the side-valve type that is mainly employed in general-purpose engines and the overhead-valve type that is employed in automotive engines and the like. The driving gear employs gear drive, chain drive, or timing belt drive. The sleeve valve mechanism is arranged such that a sleeve which is fitted to the inner surface of a cylinder is driven to move up and down or to rotate, thereby opening and closing inlet and exhaust ports.

The rotary valve is a mechanism in which a rotor is provided in a part of the inlet/exhaust passage or the combustion chamber and this rotor is rotated to provide communication with the inlet and exhaust ports. Sleeve valves include a rotary sleeve valve in which a sleeve is rotated to open and close the inlet and exhaust ports, as disclosed, for example, in Japanese Registered Utility Model Publication No. 368237 (JP, Z2, 36823) and Japanese Utility Model Application Post-Exam Publication No. 25-5704 (JP, Y1, 25-5704). Internal combustion engines that employ such sleeve valves have advantages: high ventilation efficiency for admission and exhaust owing to a relatively large valve bore area; relatively simple valve mechanism; and less noise.

However, no sleeve-valve type internal combustion engine is presently put to practical use except for special use application from the viewpoint of the difficulty in maintaining the air tightness between the sleeve and the cylinder block, the difficulty in lubricating the rotational contact surfaces, the frictional loss, etc. The above-described sleeve valve-type internal combustion engine is an art in the past and suffered from the problem that it was impossible to increase the compression ratio to a high level since it was impossible to completely prevent gas leakage and effect the required lubrication with the level of sealing technique at the time of development of the art.

DISCLOSURE OF THE INVENTION

The present invention, which has been made with the above-described technical background, attains the following objects.

It is an object of the present invention to provide a novel rotary sleeve-valve internal combustion engine which has neither inlet nor exhaust valve.

It is another object of the present invention to provide a rotary sleeve-valve internal combustion engine having a structure which is designed so that the admission and exhaust efficiency is improved.

It is still another object of the present invention to provide a rotary sleeve-valve internal combustion engine which is designed so that the sealing effectiveness of the rotary sleeve valve is improved.

It is a further object of the present invention to provide a rotary sleeve-valve internal combustion engine with a piston structure improved to raise the exhaust efficiency of the exhaust gas.

It is a still further object of the present invention to provide a rotary sleeve-valve internal combustion engine having a cylinder head structure which is designed so that the admission and exhaust efficiency is improved.

It is a still further object of the present invention to provide an opposed-piston type rotary sleeve-valve internal combustion engine which is designed so that the compression ratio can be increased with a cylinder of small capacity.

It is a still further object of the present invention to provide an opposed-piston type rotary sleeve-valve internal combustion engine which is designed so that the sealing effectiveness of the sleeve valve is improved The present invention provides the advantageous effects that the valve mechanism for admission and exhaust is extremely simple and hence the noise that is generated from the valve mechanism is relatively low.

To attain the above-described objects, the present invention has the following features A first principal means of the present invention is a rotary sleeve-valve internal combustion engine comprising:

a. an engine block (1);
b. an inlet port (10) provided in the engine block (1) to suck in a fuel mixture;
c. an exhaust port (15) provided in the engine block (1) to discharge the fuel mixture;
d. a cylindrical rotary cylinder valve (3) rotatably supported in the engine block (1), the valve (3) being hermetically sealed at one end thereof and opened at the other end and having a cylindrical space therein;
e. an opening (5) provided in the outer peripheral wall surface of the rotary cylinder valve (3) to communicate with the inlet port (10) during admission and with the exhaust port (15) during exhaust;
f. a gear (4) provided on one end of the rotary cylinder valve (3);
g. a piston (P) slidably fitted in the cylindrical space in the rotary cylinder valve (3);

h. a crankshaft (20) connected to the piston (P) through a connecting rod (30); and i. a crank gear (26) provided on the crankshaft (20) to be in mesh with the gear (4).

The first means may further comprise a cylinder head (47) which is formed at one end of the rotary cylinder valve (3) as an integral part of it for gas seal.

In addition, the first means may further comprise a cylinder head (47*a*) which is inserted into one end of the rotary cylinder valve (3) for gas seal, the cylinder head (47*a*) being secured to the engine block (1).

It is more preferable to provide an annular seal ring (40) which is disposed around the opening (5) to be in contact with the inner peripheral wall surface (7) of the engine block (1) in order to effect gas seal for the inlet port (10) and the exhaust port (15).

A second principal means of the present invention is characterized by providing the first means with spring exhaust means for discharging the exhaust gas remaining in the rotary cylinder valve (83) during the exhaust cycle of the piston (P) by the spring pressure of a spring (34) that is interposed between the piston (P) and the connecting rod (30) that connects together the piston (P) and the crankshaft (20). With this arrangement, the exhaust efficiency is improved.

It is more preferable to provide the spring exhaust means with stoppers (35) and (36) which prevent a piston body (33) constituting the piston (P) from moving in excess of a predetermined distance against the spring (34).

The first means may further comprise an upper piston (50) which is secured to the engine block (1) through a spring (66) so as to be movable only in the axial direction of the rotary cylinder valve (3), the upper piston (50) being inserted into the rotary cylinder valve (3). With this arrangement, the exhaust efficiency is improved.

The exhaust efficiency is also improved by providing an upper piston (50) between the rotary cylinder valve (3) and the engine block (1), the upper piston (50) being provided with a spring (87) and a bearing (86) so as to be rotatable and movable in the axial direction of the rotary cylinder valve (3).

If a stopper surface (67) is provided to prevent the upper piston (P) from moving in excess of a predetermined distance against the spring (66), the arrangement becomes even more effective.

If an annular seal ring (40) is disposed around the opening (5) to be in contact with the inner peripheral wall surface (7) of the engine block (1) in order to effect gas seal for the inlet port (10) and the exhaust port (15), the arrangement becomes even more effective.

A third principal means of the present invention is an opposed-piston type rotary sleeve-valve internal combustion engine comprising:

a. an engine block (1);

b. an inlet port (10) provided in the engine block (1). to suck in a fuel mixture;

c. an exhaust port (15) provided in the engine block (1) to discharge exhaust gas;

d. a rotary cylinder valve (3) rotatably supported in the engine block (1), the valve (3) being opened at both ends and having a cylindrical space therein;

e. an opening (5) provided in the outer peripheral wall surface of the rotary cylinder valve (3) to communicate with the inlet port (10) during admission and with the exhaust port (15) during exhaust;

f. gears (4) provided on both ends, respectively, of the rotary cylinder valve (3);

g. two pistons ($_1$) and ($P_2$) slidably fitted in the cylindrical space in the rotary cylinder valve (3) in such a manner as to face each other across the opening (5);

h. two crankshafts (20) connected to the two pistons ($_1$) and ($P_2$) through two connecting rods (30), respectively; an i. crank gears (26) provided on the two crankshafts (20) to be in mesh with the gears (4), respectively.

If the third means further comprises an annular seal ring (40) disposed around the opening (5) to be in contact with the inner peripheral wall surface (7) of the engine block (1) in order to effect gas seal for the inlet port (15) and the exhaust port (15), the arrangement becomes more effective.

BRIEF DESCRIPTION OF THE DRAWINGS

FIG. 13(*b*) is an enlarged view of the part b of FIG. 13(*a*).

BEST MODE FOR CARRYING OUT THE INVENTION

First embodiment

Figure 1:
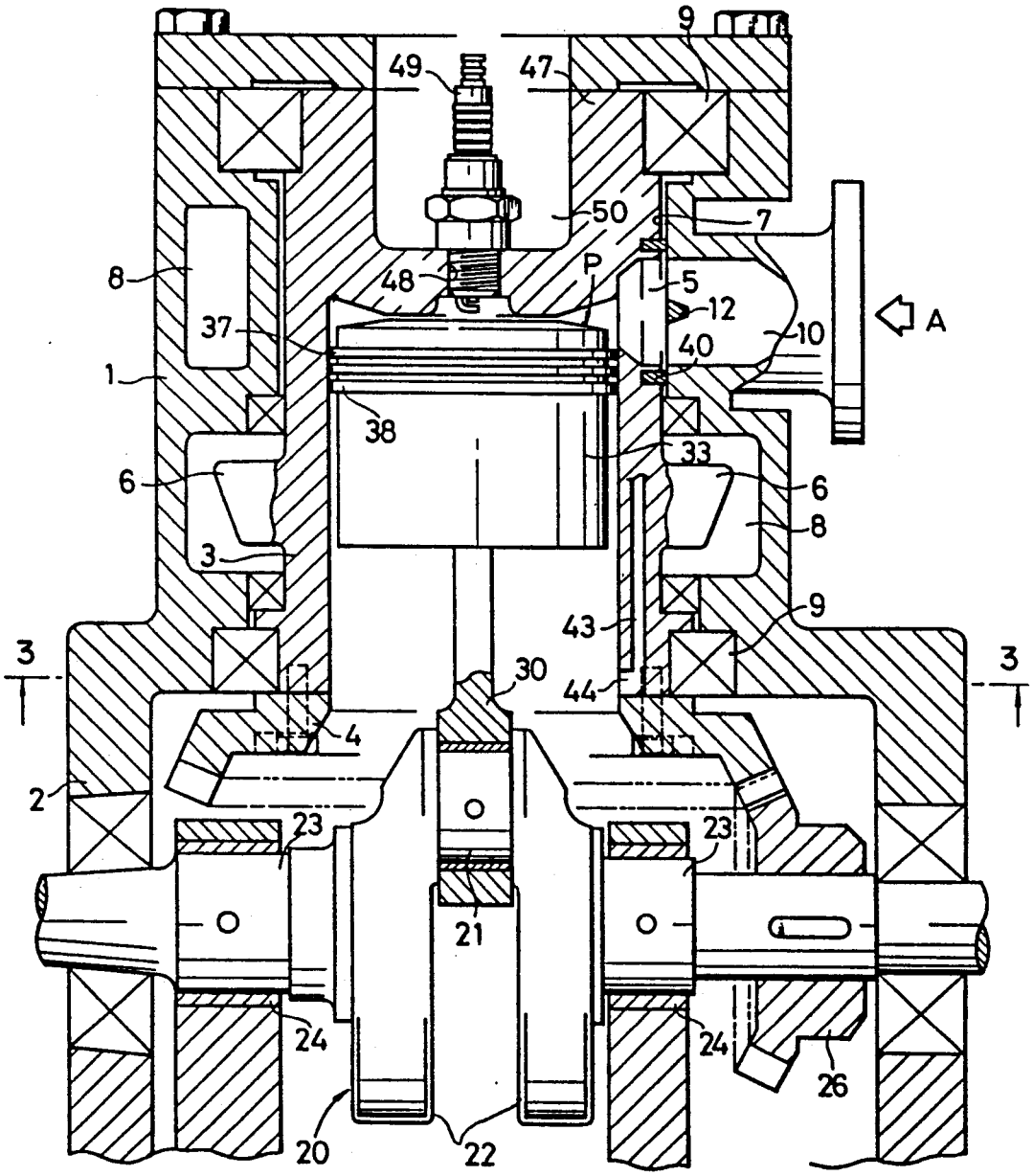
FIG. 1 is a sectional view of a first embodiment of the exhaust device of the rotary sleeve-valve internal combustion engine.

Embodiments of the present invention will be described below with reference to the drawings. FIG. 1 shows a first embodiment of the rotary sleeve-valve internal combustion engine. An engine block 1 is a hollow cylindrical casing which is made of a casting material generally used as an engine material. The engine block 1 has a crank case 2 provided at the lower end thereof. The crank case 2 has a crankshaft 20 incorporated therein. A cylindrical rotary cylinder valve 3 is rotatably supported inside the engine block 1.

A bevel gear 4 is connected to one end of the rotary cylinder valve 3 as one unit. The bevel gear 4 may be produced as a member separate from the rotary cylinder valve 3 and assembled together with it after being subjected to gear cutting. The central portion of the rotary cylinder valve 3 is provided with an opening 5 which is elliptic as viewed from the bore and circular at the exit (see FIG. 2). The outer periphery of the rotary cylinder valve 3 is provided with a plurality of radial vanes 6 as integral parts of the rotary cylinder valve 3. The vanes 6, which are equivalent to a kind of pump vane for circulating cooling water, have a lead angle with respect to the axis of rotation of the rotary cylinder valve 3. However, the vanes 6 are not always needed fundamentally, but provided only when the cooling efficiency is to be improved.

The engine block 1 is provided with an inlet port 10 and an exhaust port 15. The opening positions of the inlet and exhaust ports 10 and 15 are set so as to conform with the engine cycle, i.e., admission, compression, expansion and exhaust, in synchronism with the rotation of the opening 5. The area between the rotary cylinder valve 3 and the engine block 1 is a hollow space, which is defined as a cooling chamber 8 for containing cooling water to cool the rotary cylinder valve 3. The cooling chamber 8 is filled with a cooling liquid to cool the outer periphery of the rotary cylinder valve 3.

In addition, both ends of the rotary cylinder valve 3 are rotatably supported by respective bearings 9. The bearings 9 are made of a heat-resistant and corrosion-resistant material and designed to be capable of bearing thrust load. The crankshaft 20 comprises a pin 21 disposed in the center thereof and two arm portions 22 disposed at both ends, respectively, to face each other across the pin 21, each arm portion 22 having a journal portion 23 which is eccentric with respect to the pin 21. Each journal portion 23 is supported by a bearing 24 inside the crank case 2.

A crank gear 26 is provided on one end of the crankshaft 20 as either an integral part thereof or a member separate therefrom. The crank gear 26 is a bevel gear that is in mesh with the bevel gear 4 provided at one end of the rotary cylinder valve 3 to drive the rotary cylinder valve 3. The gear ratio of the crank gear 26 to the bevel gear 4 is 1:2. The bevel gear 4 makes one revolution at every two revolutions of the crank gear 26.

One end of a connecting rod 30 is rotatably attached to the pin 21 of the crankshaft 20. The other end of the connecting rod 30 has a piston pin (not shown) inserted therein and is inserted into a piston body 33. The piston body 33 has two pressure rings 37 and an oil ring 38 fitted into respective grooves provided on the outer periphery thereof.

Figure 2:
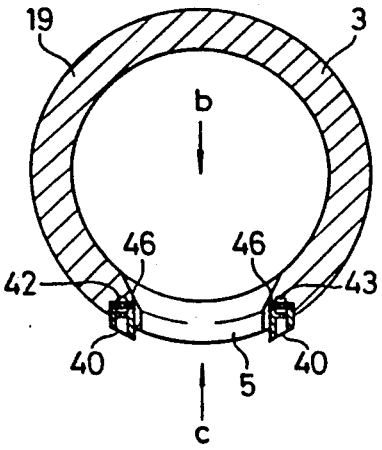
FIGS. 2(*a*), 2(*b*), 2(*c*) and 2(*d*) show the arrangement of a gas seal mechanism for an opening.
Figure 2:
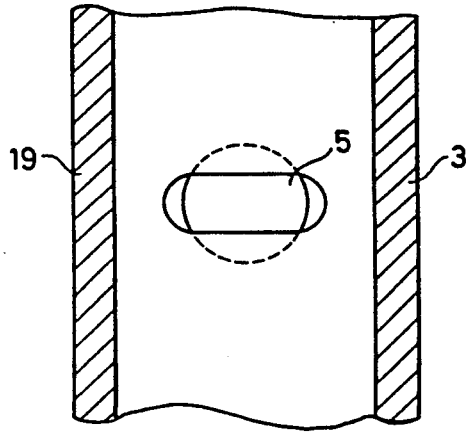
Figure 2:
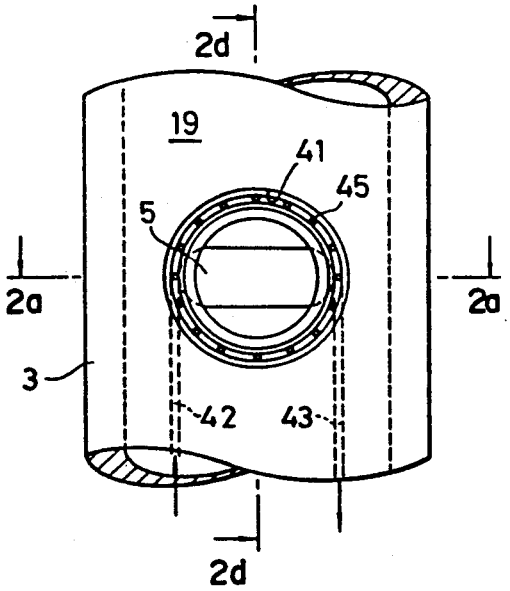
Figure 2:
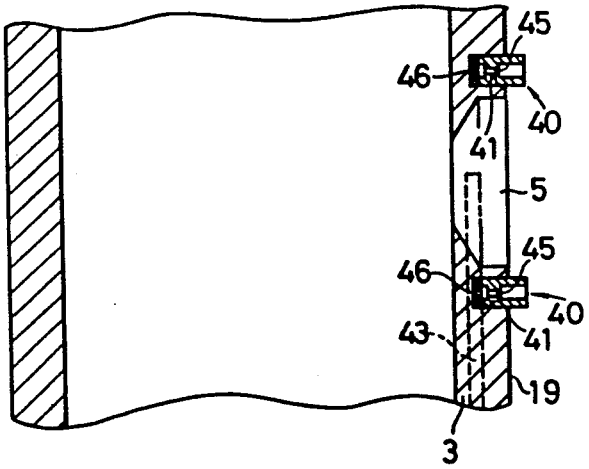

FIGS. 2(*a*), 2(*b*), 2(*c*) and 2(*d*) show the structure and configuration of a seal ring 40 for the opening 5 of the rotary cylinder valve 3. FIG. 2(*a*) is a sectional view of the opening 5 of the rotary cylinder valve 3 taken along a plane perpendicular to the axis, FIG. 2(*b*) is a view seen from the direction of the arrow b in FIG. 2(*a*), that is, from the bore. FIG. 2(*c*) is a view seen from the direction of the arrow c in FIG. 2(*a*), that is, from the outside. FIG. 2(*d*) is a sectional view taken along the line d—d in FIG. 2(*c*).

As will be understood from the figures, the opening 5 is elliptic at the end thereof which is contiguous with the bore of the rotary cylinder valve 3, but it is circular at the exit. If the end of the opening 5 which is contiguous with the bore is circular, the dimension of the opening 5 in the direction of travel of the piston P increases, resulting in a lowering in the compression ratio. In other words, the pressure rings 37 on the piston P prevent gas leakage in a case where compression is effected in excess of the opening 5.

A seal ring 40 is disposed on the outer peripheral surface 19 of the rotary cylinder valve 3 and on the circumference of the opening 5. The seal ring 40 is annular and has a cylindrical curved surface so as to be conformable to the outer peripheral surface 19 of the rotary cylinder valve 3. A ring groove 41 is formed along the circumference of the opening 5 in the outer peripheral surface 19. The ring groove 41 is fitted with the seal ring 40. The ring groove 41 is communicated with an oil feed passage 42.

In the meantime, the ring groove 41 is communicated with an oil discharge passage 43. The oil feed passage 42 and the oil discharge passage 43 are communicated with the inside of the crank case 2 through respective axial holes provided in the rotary cylinder valve 3. The crank case 2 is filled up with engine oil, which is constantly stirred by the crankshaft 20.

Figure 3:
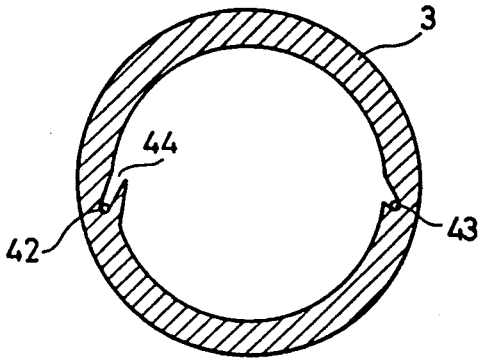
FIG. 3 is a sectional view taken along the line III—III of FIG. 1, which shows an oil inlet of a rotary cylinder valve.

As the rotary cylinder valve 3 rotates, the engine oil is fed in from an oil inlet 44 (see FIG. 3), and the excess oil filling the ring groove 41 is returned to the crank case 2 through the oil discharge passage 43. It should be noted that the oil inlet 44 faces tangentially to the bore of the rotary cylinder valve 3 to facilitate taking in of the oil (see FIG. 3).

Meantime, the seal ring 40 is substantially rectangular in cross-section and has oil through-holes 45 which are circumferentially provided at predetermined intervals. The oil through-holes 45 allow the oil to ooze out to the outer surface of the seal ring 40 from the bottom of the ring groove 41. The oil oozing out to the surface fills an oil groove provided in the surface of the seal ring 40. The bottom of the seal ring 40 is similarly provided with an oil groove so that the oil flows through the area between the oil through-holes 45.

In addition, a corrugated leaf spring 46 is inserted in the area between the bottom of the ring groove 41 and the bottom of the seal ring 40 to push the seal ring 40 outwardly at all times. The seal ring 40 is pressed against the inner peripheral wall surface 7 of the engine block 1 to maintain the air tightness. In addition, as the rotary cylinder valve 3 rotates, the seal ring 40 is centrifugally pressed against the inner peripheral wall surface 7 of the engine block 1, thereby enabling the air tightness to be maintained more effectively. In this sense, the air tightness is maintained even more effectively by making the weight of the seal ring 40 heavier than in the above-described embodiment. The air tightness can be maintained not only when the rotary cylinder valve 3 rotates at high speed but also when it rotates at low speed.

A cylinder head 47 is provided as an integral part of the rotary cylinder valve 3 at the upper side of the engine block 1. A plug threaded hole 48 is formed in the center of the cylinder head 47. The center of the cylinder head 47 is formed with a plug accommodating hole 50 for accommodating an ignition plug 49.

Figure 4:
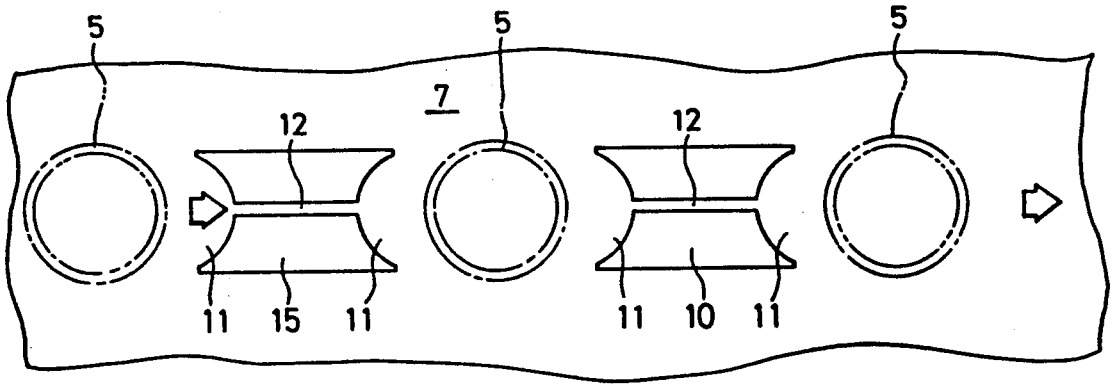
FIG. 4 is a developed view showing the configurations of an exhaust port and an inlet port.

The ignition plug 49 is fitted into the plug threaded hole 48. FIG. 4 is a developed view showing the configurations of the inlet and exhaust ports 10 and 15 provided in the engine block 1. The size (as viewed in the figure) of the exhaust and inlet ports 15 and 10 is substantially the same as the diameter of the opening 5. Each of the exhaust and inlet ports 15 and 10 has semicircular projections 11 at both circumferential ends thereof, the projections 11 having the same diameter as that of the inlet port 10.

Each pair of semicircular projections 11 are connected together by a bridge portion 12. The bridge portion 12 is provided in order to stabilize and prevent the seal ring 40 from falling off during the rotation of the rotary cylinder valve 3. However, the bridge portion 12 is not always needed. It is preferable to provide no bridge portion 12 with a view to improving the admission and exhaust efficiency. Since the exhaust port 15 has the same configuration as that of the inlet port 10, description thereof is omitted.

Operation

The engine having the foregoing structure operates as follows. The crankshaft 20 is driven to rotate with a starter (not shown). As the piston P travels toward the bottom dead center, the respective positions of the opening 5 and the inlet port 10 coincide with each other, so that the fuel mixture is sucked in from the opening 5. The fuel mixture A is supplied from a known carburetor (not shown). The amount of intake gas during the admission cycle reaches a maximum in the middle of overlapping of the opening 5 and the inlet port 10 and decreases as the overlapping approaches an end, and when the overlapping comes to an end, the admission terminates (FIG. 4).

Meantime, the crank gear 26 on the crankshaft 20 drives the rotary cylinder valve 3 to adjust the timing such that the opening 5 and the inlet port 10 coincide with each other. The piston P then travels toward the top dead center, that is, compresses the fuel mixture A. Immediately before the piston P reaches the top dead center, the opening 5 coincides with the position of the ignition plug 49 and the compressed fuel mixture is ignited, and after the piston P reaches the top dead center, the fuel mixture is burned to expand.

The piston P is pushed to travel by the combustion gas, thereby driving the crankshaft 20 through the connecting rod 30 and the pin 21. As the piston P rises again, the opening 5 and the exhaust port 15 communicate with each other to discharge the exhaust gas to the outside of the engine from the exhaust port 15.

Second embodiment

Figure 5:
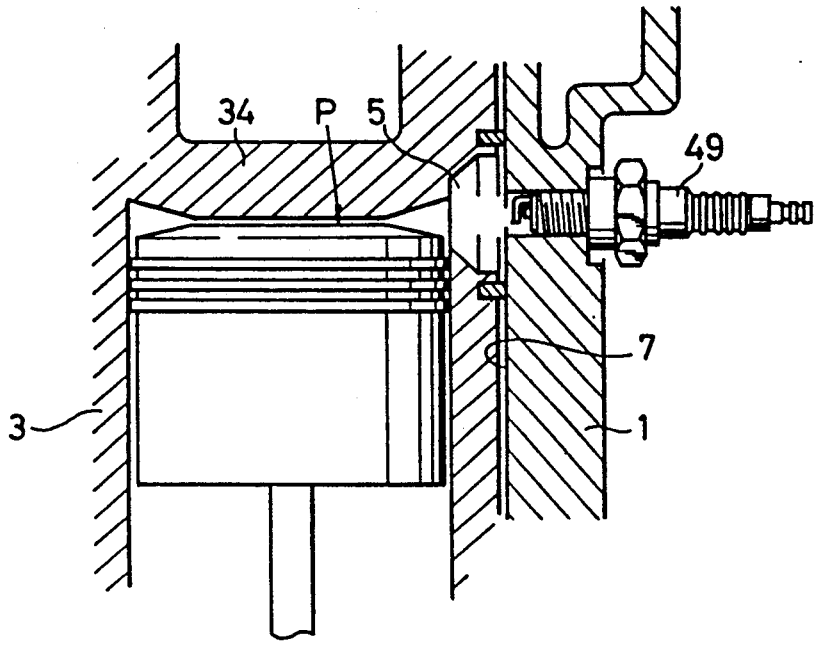
FIG. 5 is a sectional view of another embodiment in which an ignition plug is provided on the side surface of the rotary cylinder valve.

FIG. 5 is a sectional view of an embodiment in which the ignition plug 49 is provided on the side surface of the engine block 1. The ignition plug 49 is provided on the engine block 1 so that the opening 5 of the rotary cylinder valve 3 coincides with the position of the ignition plug 49 during the compression stroke. This embodiment has the advantage that the engine head structure is simplified.

Third embodiment

Figure 6:
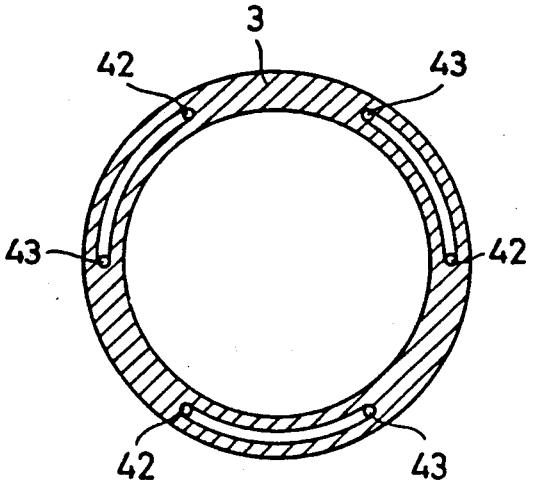
FIGS. 6(*a*) and 6(*b*) show another example of the rotary cylinder valve.
Figure 6:
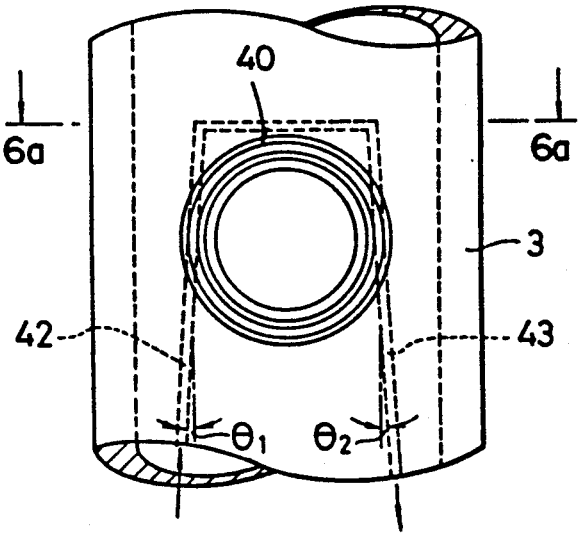

FIGS. 6(*a*) and 6(*b*) show another example of the rotary cylinder valve 3. FIG. 6(*a*) is a transverse sectional view of the rotary cylinder valve 3, and FIG. 6(*b*) is a view seen from the direction of the arrow b in FIG. 6(*a*). The rotary cylinder valve 3 in the foregoing embodiment has a single seal ring 40. In this embodiment, two seal rings 40 are provided in the form of a double seal ring structure. Because of the double seal ring structure 40, the seal performance is improved. In addition, the oil feed passage 42 in this embodiment is inclined at $\theta_1$ with respect to the central axis of the rotary cylinder valve 3.

The oil entering through the oil inlet 44 is raised to the upper part of the rotary cylinder valve 3 by the centrifugal force produced by the rotation of the rotary cylinder valve 3, thereby feeding the seal rings 40 with oil. Thereafter, the oil is discharged from the oil discharge passage 43. The oil discharge passage 43 is also inclined at $\theta_2$ with respect to the axis of the rotary cylinder valve 3 in the opposite direction to that in which the oil feed passage 42 is inclined at the angle $\theta_1$. Accordingly, the component force is centrifugally inclined, so that the oil is discharged even more smoothly.

Fourth embodiment

Figure 7:
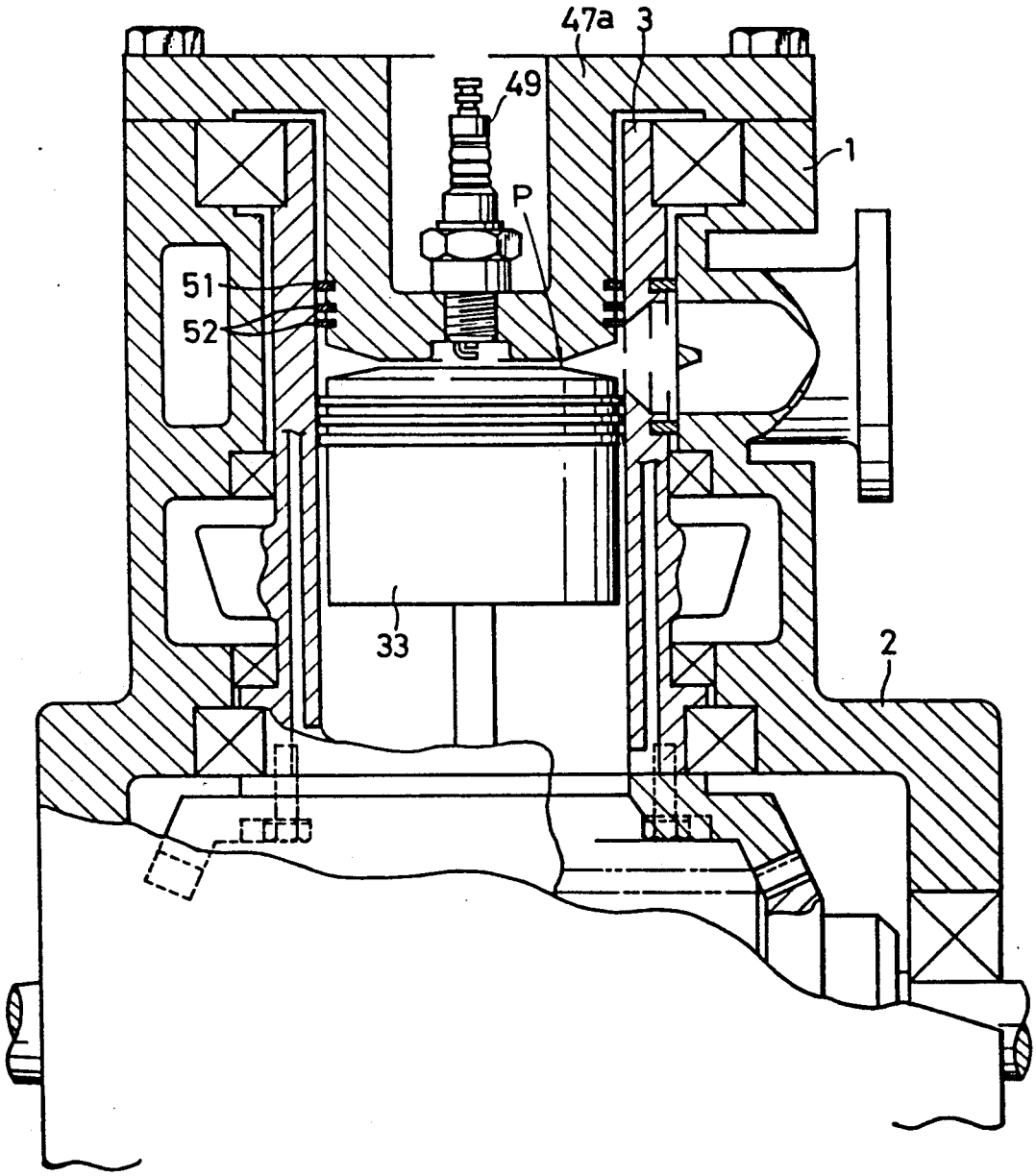
FIG. 7 is a sectional view of a fourth embodiment of the rotary sleeve-valve internal combustion engine.

FIG. 7 shows an embodiment which is a modification of the first embodiment. A great feature of this embodiment resides in that a cylinder head 47*a* is secured to the engine block 1 by use of bolts and the rotary cylinder valve 3 and the cylinder head 47*a* are arranged to be slidable relative to each other. An oil ring 51 and two pressure rings 52 are fitted around the outer periphery of the lower portion of the cylinder head 47*a*.

The oil ring 51 and the pressure rings 52 are provided in order to prevent the leakage of the compressed gas through the gap between the cylinder head 47 and the rotary cylinder valve 3, which rotate relative to each other. In all the foregoing embodiments, the present invention is applied to an rotary sleeve-valve internal combustion engine.

Fifth embodiment

Figure 8:
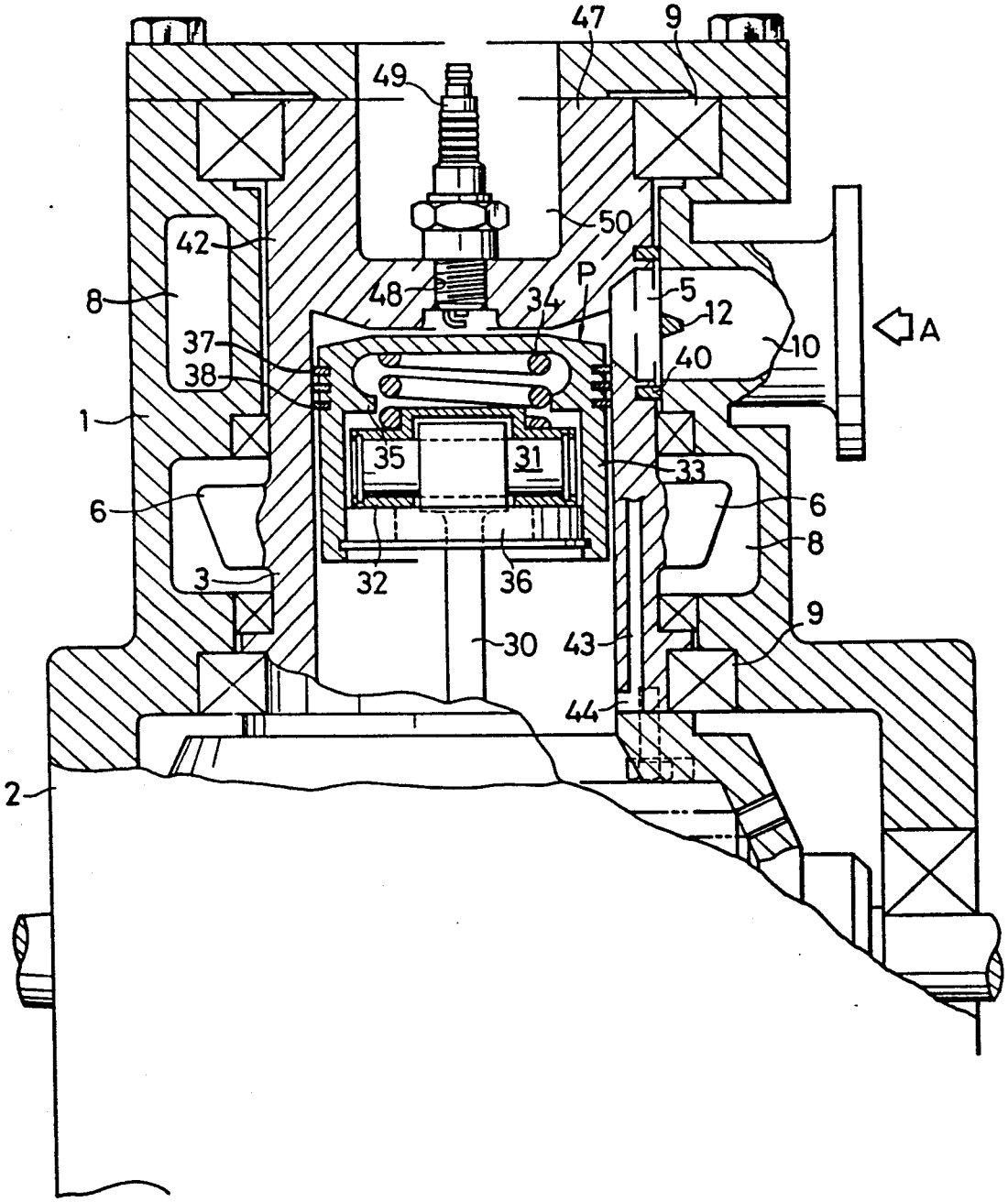
FIG. 8 is a sectional view of a fifth embodiment of the rotary sleeve-valve internal combustion engine which is improved in the exhaust efficiency by incorporating a spring into a piston.

FIG. 8 shows a fifth embodiment. The piston P in the foregoing embodiments is the same as that used in the conventional internal combustion engines. The fifth embodiment differs from the first to fourth embodiments in the structure of the piston P. A piston pin 31 is inserted into the second end of the connecting rod 30. Both ends of the piston 31 are secured to a piston support 32.

A piston body 33 is provided outside the piston support 32 in such a manner as to be movable axially of the rotary cylinder valve 3 through a coil spring 34. The piston pin 31, the piston support 32, the coil spring 34 and the piston body 33 constitute in combination a piston P.

In addition, the piston body 33 has an upper stopper 35 integrally formed on the upper portion of the inside thereof and also has a lower stopper 36 secured to the lower portion thereof. The piston body 33 is movable relative to the piston support 32 by a distance l between the upper stopper 35 and the lower stopper 36. It should be noted that the embodiment shown in FIG. 8 is substantially the same as the first embodiment shown in FIG. 1 except for the above-described portion. However, the present invention is not limited thereto, but it may be applied to ordinary internal combustion engines other than rotary sleeve-valve internal combustion engines, for example, the type of engine described in the fourth embodiment shown in FIG. 7.

Operation

The crankshaft 20 is driven to rotate with a starter (not shown). As the piston P travels toward the bottom dead center, the opening 5 and the inlet port 10 coincide with each other, so that the fuel mixture is sucked in from the opening 5. Upon completion of the admission stroke, the piston P travels toward the top dead center, that is, compresses the fuel mixture A. The compression causes the piston body 33 to move a little.

Figure 9:
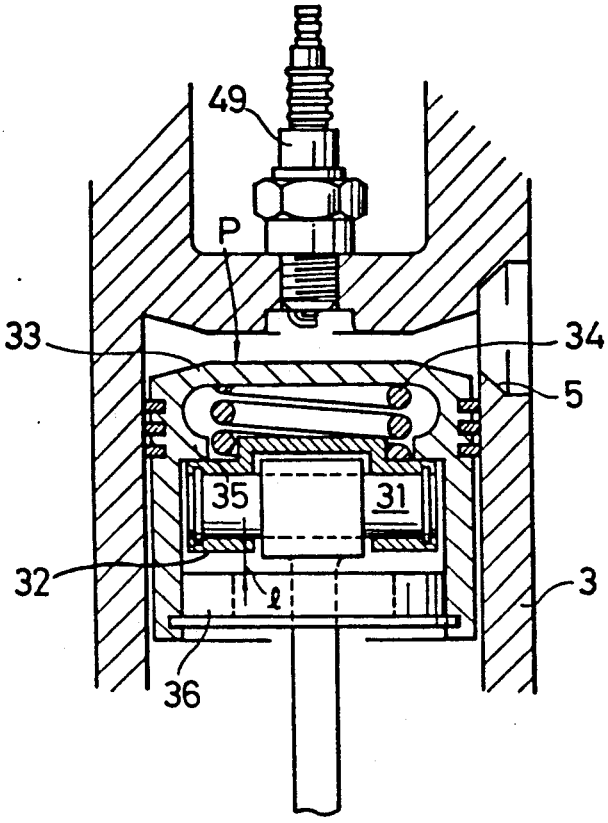
FIGS. 9(*a*) and 9(*b*) are sectional views showing the operation of the piston in the fifth embodiment.
Figure 9:
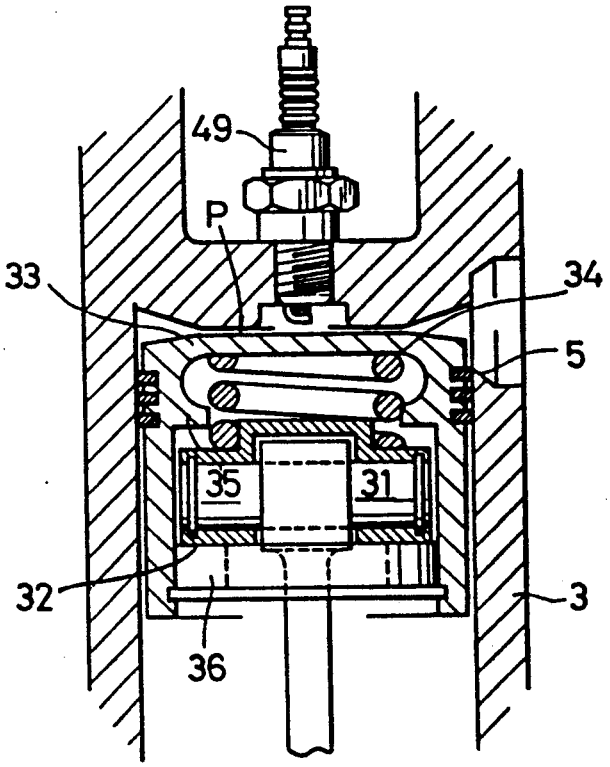

In other words, the coil spring 34 is compressed (see FIG. 9(*a*)). At this time, the piston body 33 travels through the distance l until the upper stopper 35 abuts against the top surface of the piston support 32. The distance of travel of the piston body 33 is determined by the position where the stiffness of the coil spring 34 and the compressive pressure balance with each other. Accordingly, the piston body 33 does not always travel through the distance 1. The distance l is the maximum travel distance.

The spring pressure of the coil spring 34 is determined by the compression ratio which is, in turn, determined from the engine efficiency. Immediately before the piston P reaches the top dead center, the opening 5 coincides with the position of the ignition plug 49 and the compressed fuel mixture is ignited, and after the piston P reaches the top dead center, the fuel mixture is burned to expand. The piston P is pushed to travel by the combustion gas, thereby driving the crankshaft 20 through the connecting rod 30.

At this time, the piston body 33 is simultaneously pushed by the explosively burned gas to compress the coil spring 34 temporarily, but it returns to its position before the compression. The explosively burned gas does not rapidly push the piston P, but gives leveled force to the piston P. Then, the piston P rises, so that the opening 5 and the exhaust port 15 communicate with each other to discharge the exhaust gas to the outside of the engine from the exhaust port 15 (see FIG. 9(*b*)).

At this time, the lower stopper 36 of the piston body 33 is brought into contact with the piston support 32 by the force from the coil spring 34. Since the gap between the cylinder head 47 and the piston body 33 during the exhaust stroke is extremely small, the exhaust gas is discharged substantially completely. This operation is repeated thereafter.

Sixth embodiment

Figure 10:
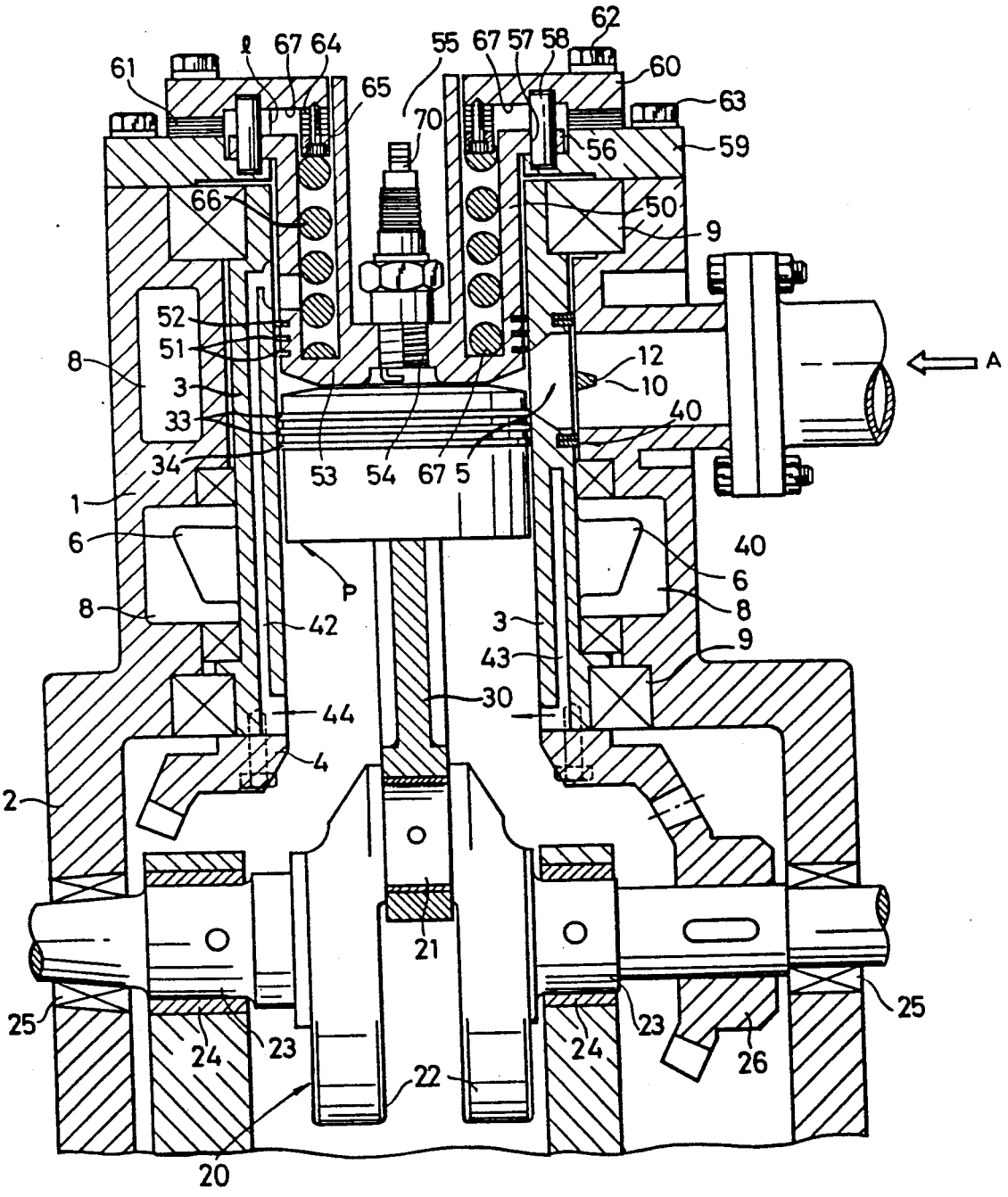
FIG. 10 is a sectional view of a sixth embodiment.

FIG. 10 shows a sixth embodiment The rotary cylinder valve 3 has an upper piston 50 inserted in the upper part thereof. The upper piston 50 is in the shape of a cylinder one end of which is closed and the other end of which is open. The upper piston 50 has piston rings 51 and an oil ring 52, which are fitted to the outer periphery thereof. The piston rings 51 are provided in order to maintain the air tightness between the rotary cylinder valve 3 and the upper piston 50.

The center of the end face 53 of the upper piston 50 is formed with a plug threaded hole 54. The plug threaded hole 54 has an ignition plug 70 fitted therein. The center of the upper piston 50 is formed with a plug accommodating hole 55 for accommodating the ignition plug 70. The upper piston 50 has a flange 56 formed at the upper end thereof.

The flange 56 has a plurality of circular guide holes 57 provided at respective positions which are spaced at equal angular distances. Each guide hole 57 has a guide pin 58 slidably inserted therein. The upper piston 50 can move while being slidably guided along the guide pins 58. One end of each of the guide pins 58 is secured in a disk plate 59, and the other end in a disk plate 60.

A stack of washers 61 is interposed between the disk plates 59 and 60. The washers 61 are employed to adjust the gap between the disk plates 59 and 60. Bolts 62 fasten together the disk plate 60 and the washers 61. The disk plate 59 is secured to the engine block 1 by use of bolts 63.

A spring retainer 65 is secured to the central portion of the disk plate 60 by bolts through washers 64. A coil spring 66 is interposed between the spring retainer 65 and the inner end face 67 of the upper piston 50. Accordingly, the upper piston 50 is constantly pressed toward the piston P by the compressive force from the coil spring 66. The washers 64 are employed to adjust the level of force from the coil spring 66.

Operation

The engine having the foregoing structure operates as follows. The crankshaft 20 is driven to rotate with a starter (not shown). As the piston P travels toward the bottom dead center, the opening 5 and the inlet port 10 coincide with each other, so that the fuel mixture A is sucked in from the opening 5. The fuel mixture A is supplied from a known carburetor (not shown).

Meantime, the crank gear 26 on the crankshaft 20 drives the rotary cylinder valve 3 to adjust the timing such that the opening 5 and the inlet port 10 coincide with each other. The piston P then travels toward the top dead center, that is, compresses the fuel mixture A. The compression causes the piston body 33 to move a little, causing the coil spring 66 to be compressed.

The flange 56 travels through a distance l while being guided by the pins 58 until it abuts against the stopper face 67 of the disk plate 60. The distance of travel of the flange 56 is determined by the position where the stiffness of the coil spring 66 and the compressive pressure balance with each other. Accordingly, the flange 56 of the upper piston 50 does not always travel through the distance l. The distance l is the maximum travel distance.

The spring pressure of the coil spring 66 is determined by the compression ratio which is, in turn, determined from the engine efficiency. Immediately before the piston P reaches the top dead center, the opening 5 coincides with the position of the ignition plug 70 and the compressed fuel mixture is ignited, and after the piston P reaches the top dead center, the fuel mixture is burned to expand. The piston P is pushed to travel by the combustion gas, thereby driving the crankshaft 20 through the connecting rod 30 and the pin 21.

At this time, the upper piston 50 is simultaneously pushed by the explosively burned gas to compress the coil spring 66 temporarily, but it releases the compressive energy and returns to its position before the compression. The explosively burned gas does not rapidly push the piston 32, but gives leveled force to the piston 32. Then, the piston P rises, so that the opening 5 and the exhaust port 15 communicate with each other to discharge the exhaust gas to the outside of the engine from the exhaust port 15.

Since the gap between the upper piston 50 and the piston P during the exhaust stroke is extremely small, the exhaust gas is discharged substantially completely. This operation is repeated thereafter.

Seventh embodiment

Figure 11:
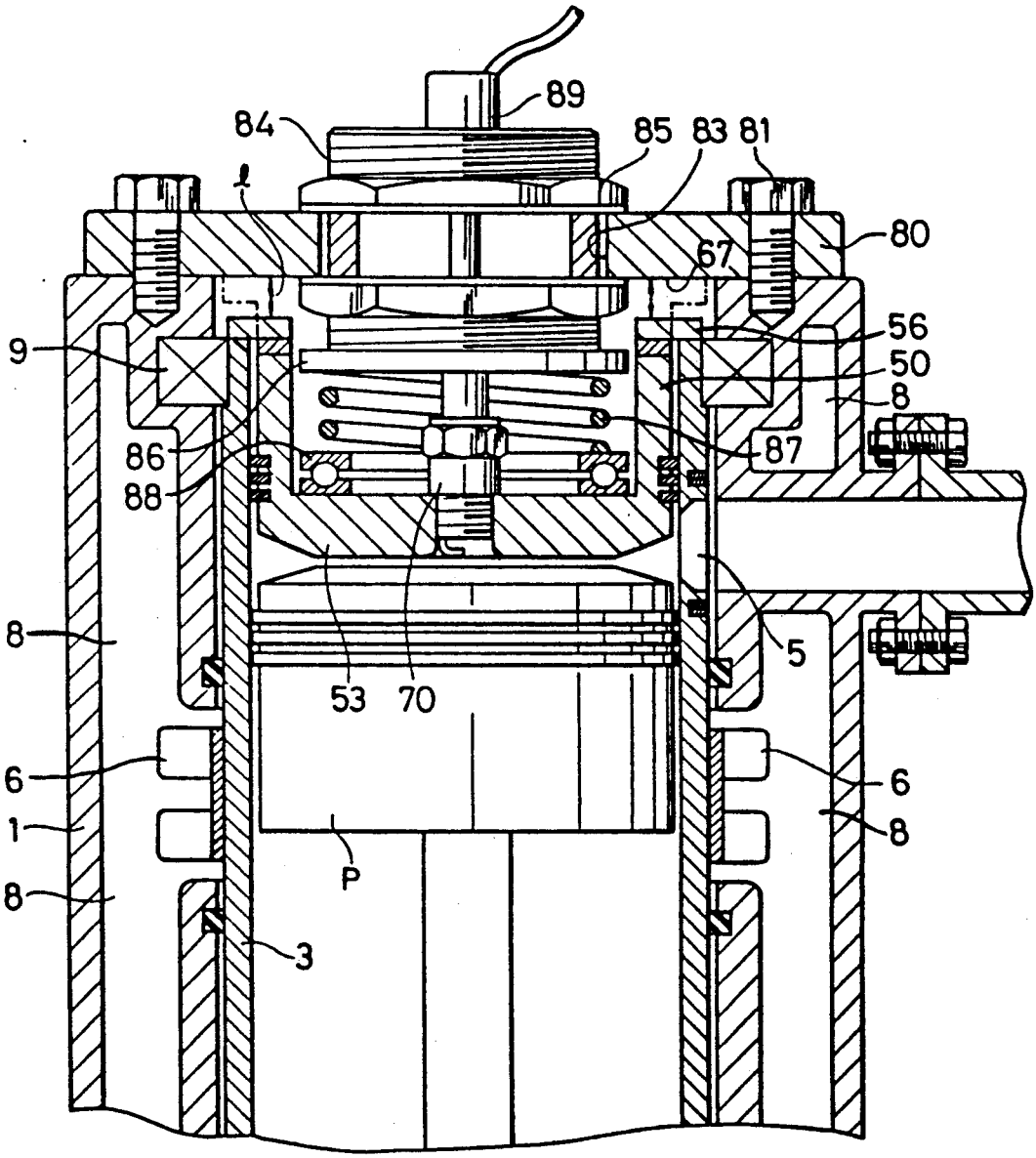
FIG. 11 is a sectional view of a seventh embodiment.

FIG. 11 is a sectional view of a seventh embodiment. In the above-described sixth embodiment, the upper piston 50 is fixed, and the rotary cylinder valve 3 slides and rotates relative to the upper piston 50. In this second embodiment, the rotary cylinder valve 3 and the upper piston 50 are rotated together as one unit.

A plate 80 is secured to the top of the engine block 1 by use of bolts 81. The plate 80 has a mounting hole 83 formed in the center thereof. The mounting hole 83 has a hollow screw cylinder 84 inserted therein. The screw cylinder 84 has lock nuts 85 screwed thereonto to secure the screw cylinder 84 to the plate 80. The screw cylinder 84 has a flange 86 formed at the lower end thereof as an integral part thereof.

A coil spring 87 and a thrust bearing 88 are interposed between the upper piston 50 and the flange 86. Accordingly, the rotary cylinder valve 3 and the upper piston 50 rotate together as one unit. The screw cylinder 84 and the coil spring 87, which are secured to the plate 80, do not rotate.

The ignition plug 70, which is similar to a conventional one, is rotated together with the upper piston 50. Therefore, a joint 89 for connecting together electric wires of the ignition plug and the ignition coil is provided. In this embodiment, since the upper piston 50 and the rotary cylinder valve 3 do not rotate relative to each other, it is easy to maintain the air tightness between the upper piston 50 and the rotary cylinder valve 3.

Eighth embodiment

Figure 12:
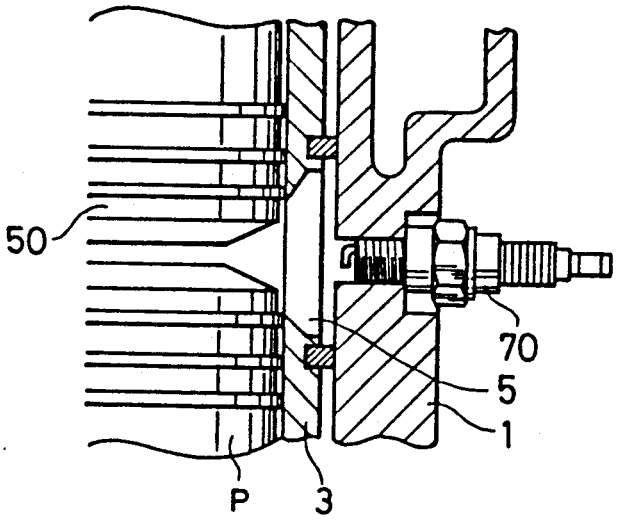
FIG. 12 is a sectional view of an eighth embodiment.

FIG. 12 is a sectional view of an eighth embodiment. The ignition plug 70 in the foregoing embodiments is secured to the upper piston 50. The ignition plug 70 does not necessarily need to be secured to the upper piston 50. The sectional view of FIG. 12 shows an example in which the ignition plug 70 is provided on the side surface of the cylinder block 1. The ignition plug 70 is provided on the cylinder block 71 such that the opening 5 of the rotary cylinder valve 3 coincides with the position of the ignition plug 70 during the compression stroke. This arrangement has the advantage that the engine head structure is simplified.

Ninth embodiment

Figure 13:
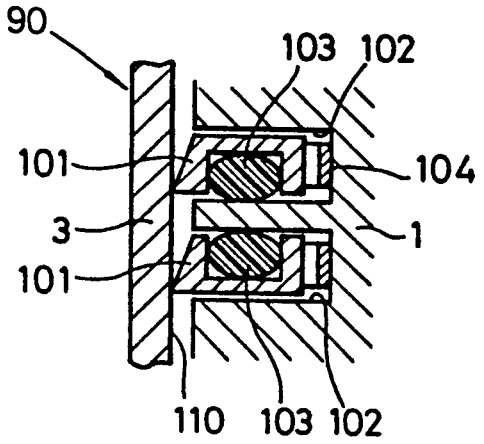
FIG. 13(*a*) is a sectional view of a ninth embodiment.
Figure 13:
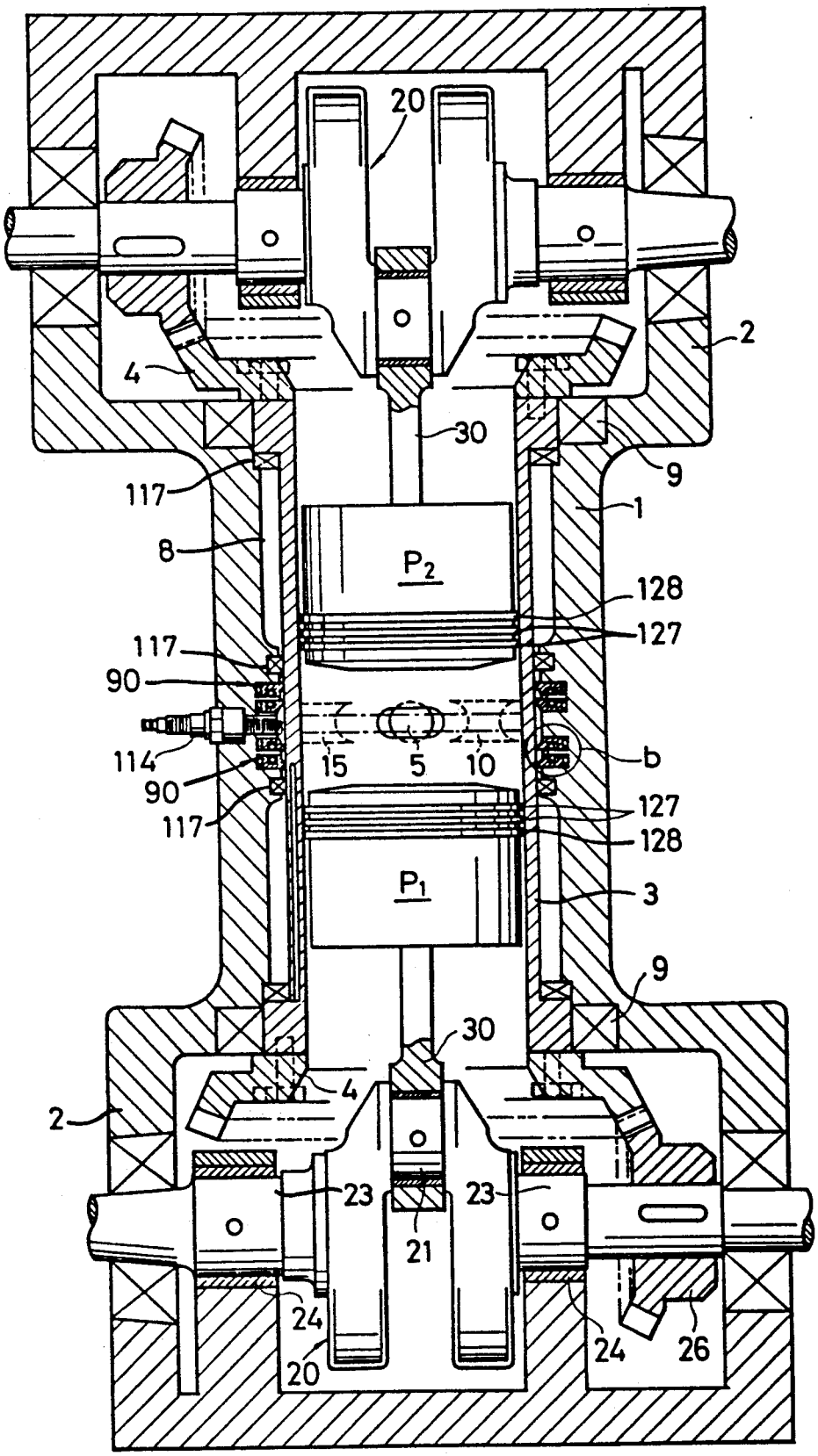

One embodiment of the present invention will be described below with reference to the drawings. FIG. 13(*a*) is a sectional view of an embodiment in which two pistons $P_1$ and $P_2$ are provided in opposing relation to each other in a single rotary cylinder valve 3. Crank cases 2 are detachably attached both ends, respectively, of the engine block 1 by use of bolts (not shown). Each crank case 2 has a crankshaft 20 incorporated therein.

Although in this embodiment the crank cases 2 are produced as members separate from the engine block 1, they may be produced by casting as integral parts of the engine block 1 as in the known arrangement. The engine block 1 has a cylindrical rotary cylinder valve 3 rotatably inserted therein. The rotary cylinder valve 3 has bevel gears 4 provided at both ends, respectively, as integral parts thereof. However, the bevel gears 4 may be produced as members separate from the rotary cylinder valve 3 and assembled together with it after being subjected to gear cutting. The central portion of the rotary cylinder valve 3 is provided with an opening 5.

The engine block 1 is provided with an inlet port 10 and an exhaust port 15. The opening positions of the inlet and exhaust ports 10 and 15 are set so as to conform with the engine cycle, i.e., admission, compression, expansion and exhaust, in synchronism with the rotation of the opening 5. Gas seal mechanisms 90 are provided on the inner peripheral surface of the engine block 1 at respective positions which face each other vertically across the inlet and exhaust ports 10 and 15, each gas seal mechanism 90 comprising two parallel seal rings. The gas seal mechanisms 90 are provided in order to effect tight sealing so that the compressed fuel mixture will not leak. The gas seal mechanisms 90 preferably have as high resistance to high temperature and high pressure as possible and also wear resistance. FIG. 13(*b*) is an enlarged view of the gas seal mechanism 90 shown in FIG. 13(*a*).

Each seal ring 101 is an annular seal, known as taper face type seal, the end of which is tapered. The seal ring 101 has an O-ring 103 inserted in a groove formed in one side surface thereof. Each combination of the seal ring 10 and the O-ring 103 is inserted into a ring groove 102 in the engine block 1. A corrugated leaf spring 104 is disposed on the bottom of the ring groove 102 to push the seal ring 101 from the bottom thereof against the outer peripheral surface 110 of the rotary cylinder valve 3 at all times.

The area between the rotary cylinder valve 3 and the engine block 1 is a hollow space, which is defined as a cooling chamber 3 for cooling the rotary cylinder valve 3. The cooling chamber 3 is filled with cooling water to cool the outer periphery of the rotary cylinder valve 3. In addition, O-rings 117 are provided at the upper and lower ends of the rotary cylinder valve 3 between it and the engine block 1. The O-rings 117 mainly prevent leakage of the cooling water.

An ignition plug 114 is screwed into the engine block at a position in between the gas seal mechanisms 90. The ignition plug 114 ignites the fuel mixture through the opening 5. In addition, both ends of the rotary cylinder valve 3 are rotatably supported by bearings 9. The bearings 9 are made of a heat-resistant and corrosion-resistant material and designed to be capable of bearing thrust load. Both ends of each crankshaft 20 are supported by the crank case 2 through journal portions 23.

A crank gear 26 is provided on one end of each crankshaft 20 as either an integral part thereof or a member separate therefrom. The crank gear 26 is a bevel gear that is in mesh with the corresponding one of the bevel gears 4 provided a both ends of the rotary cylinder 4. The crank gears 26 output power and, at the same time, drive the rotary cylinder valve 3. The gear ratio of the crank gears 26 to the bevel gears 4 is 1:2. The bevel gears 4 make one revolution at every two revolutions of the crank gears 26.

One end of a connecting rod 30 is rotatably attached to the pin 21 of each crankshaft 20. Since each piston P has a structure that has heretofore been used in the known four-cycle engines, detailed description thereof is omitted. The piston P has pressure rings 127 and an oil ring 128 fitted in respective grooves on the outer periphery thereof. Since the annular seal ring 40 for the opening 5 of the rotary cylinder valve 3 is the same as in the foregoing embodiments, description thereof is omitted.

Operation

Either of the crankshafts 20 is driven to rotate with a starter (not shown). As the two pistons $P_1$ and $P_2$ travel toward the respective bottom dead centers, that is, as the two pistons $P_1$ and $P_2$ travel away from each other, the opening 5 and the inlet port 10 coincide with each other, so that the fuel mixture is sucked in from the opening 5. The fuel mixture A is supplied from a known carburetor (not shown).

Meantime, the crank gears 26 on the crankshafts 20 drive both ends of the rotary cylinder valve 3 to adjust the timing such that the opening 5 and the inlet port 10 coincide with each other. The two pistons $P_1$ and $P_2$ P then travel toward the respective top dead centers, that is, toward each other to compress the fuel mixture. Immediately before the two pistons $P_1$ and $P_2$ reach the top dead centers, the opening 5 coincides with the position of the ignition plug 114 and the compressed fuel mixture is ignited, and after the pistons $P_1$ and $P_2$ reach the top dead centers, the fuel mixture is burned to expand.

The pistons $P_1$ and $P_2$ are pushed to travel by the combustion gas, thereby driving the crankshafts 20. As the two pistons P ascend again, the opening 5 and the exhaust port 15 communicate with each other to discharge the exhaust gas to the outside of the engine from the exhaust port 15. This operation is repeated thereafter.

This embodiment makes it possible to obtain a compression ratio which is nearly double that of the one-piston type of engine and hence possible to realize an engine of high performance. In addition, this embodiment eliminates the need for valves in the inlet and exhaust systems and hence enables a marked reduction in size of the external shape. Accordingly, the embodiment is advantageous in a case where a relatively long and narrow volumetric space is available, for example, in a case where the engine is mounted under the floor as in large-sized passenger cars (buses) or Diesel engine cars, or in a case where the engine is mounted in an engine room of a small-sized vessel.

Other embodiments

The foregoing embodiments all show examples in which the engine of the present invention is applied to a single-cylinder engine. However, the present invention may also be applied to a multi-cylinder engine, as will be understood from the above description. Any known engine arrangement may be employed, e.g., V-engine, straight-type engine, etc. Rotary cylinder valves are interlocked with each other by a gear mechanism. The gear mechanism may be such that spur gears which are attached to the rotary cylinder valves are meshed with each other. The gear mechanism may also be such that worm wheels are attached to the rotary cylinder valves and worms are meshed with the worm wheels, the worms being connected by a shaft, thereby interlocking the rotary cylinder valves with each other.

The foregoing embodiments all adopt a cooling method that employs water or other liquid for cooling. However, the cylinder outer wall may be cooled by an air cooling method. In general, the coefficient of heat transfer between air and the cylinder outer wall by air cooling is much smaller than in the case of water cooling. To make compensation therefor, the wind velocity and air flow are increased and, at the same time, the transfer area is increased by attaching a cooling fan on the outer wall. In the case of the present invention, cooling is effected even more effectively by providing a fan on the outer periphery of the rotary cylinder valve 3 to induce wind axially for cooling. There is no need to provide another fan device for cooling, and the mechanical loss is relatively small.

The gear ratio of the crank gear 26 to the bevel gear 4 of the rotary cylinder valve 3 in each of the foregoing embodiments is 1:2. That is, the bevel gear 4 makes one revolution at every two revolutions of the crank gear 26. Since the engine is a four-cycle engine, the rotary cylinder valve 3 makes one revolution every four cycles. However, if another inlet port, exhaust port and ignition plug are provided in 180° opposing relation to the first inlet port 10, exhaust port 15 and the ignition plug 49 (70 or 114), a four-cycle engine is realized even if the rotary cylinder valve 3 is rotated in the ratio of 4:1.

This may be realized either by changing the gear ratio of the rotary cylinder valve 3 to the bevel gear 4 or by interposing a gear for reduction. Since the number of revolutions of the rotary cylinder valve 3 is reduced, the amount of gas leaking through the seal ring 40 can be reduced in comparison to the described embodiments. It is also possible to reduce the rotational friction loss in comparison to the described embodiments. It should be noted that these techniques are known, for example, in Japanese Patent No. 135563 (1940) (JP, C2, 135563), Japanese Utility Model Application Post-Exam Publication No. 25-5704 (JP, Y1, 25-5704), etc.

The seal ring 40 for the opening 5 of the rotary cylinder valve 3 in the described embodiments is provided on the rotary cylinder valve 3 itself. As will be understood from the foregoing description, the seal ring 40 is provided in order to prevent leakage of gas through the area between the rotary cylinder valve 3 and the engine block 1. As long as this function is attained, the seal ring 40 may be provided on the outer periphery of each of the inlet and exhaust ports 10 and 15 in the engine block 1. In addition, the configuration and number of seal rings are not limited to the described embodiments, but any known seal ring arrangement used in internal combustion engines may be employed.

What is claimed is:

1. A rotary sleeve-valve internal combustion engine comprising:

a. an engine block (1);

b. an inlet port (10) provided in said engine block (1) to suck in a fuel mixture;

c. an exhaust port (15) provided in said engine block (1) to discharge the fuel mixture;

d. a cylindrical rotary cylinder valve (3) rotatably supported by at least one bearing (9) in said engine block (1), said valve (3) being hermetically sealed at one end thereof and opened at the other end and having a cylindrical space therein;

e. an opening (5) provided in the outer peripheral side wall surface of said rotary cylinder valve (3) to communicate with said inlet port (10) during admission and with said exhaust port (15) during exhaust;

f. a gear (4) provided on said offer end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4);

j. an annular seal ring (40) disposed around said opening (5), said seal ring (40) being pushed by centrifugal force produced by the rotation of said rotary cylinder valve (3) in come in contact with the inner peripheral wall surface (7) of said engine block (1) in order to effect gas seal for said inlet port (10) and said exhaust port (15); and k. a cylinder head (47) formed at said one end of said rotary cylinder valve (3) as an integral part of it for gas seal.

2. A rotary sleeve-valve internal combustion engine comprising:

a. an engine block (1);

b. an inlet port (10) provided in said engine block (1) to suck in a fuel mixture;

c. an exhaust port (15) provided in said engine block (1) to discharge the fuel mixture;

d. a cylindrical rotary cylinder valve (3) rotatably supported by at least one bearing (9) in said engine block (1), said valve (3) being hermetically sealed at one end thereof and opened at the other end and having a cylindrical space therein;

e. an opening (5) provided in the outer peripheral side wall surface of said rotary cylinder valve (3) to communicate with said inlet port (10) during admission and with said exhaust port (15) during exhaust;

f. a gear (4) provided on said other end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4);

j. an annular seal ring (40) disposed around said opening (5), said seal ring (4) being pushed be centrifugal force produced by the rotation of the rotary cylinder valve (3) to come in contact with the inner peripheral wall surface (7) of said engine block (1) in order to effect gas seal for said inlet port (10) and said exhaust port (15); and k. a cylinder head (47*a*) inserted into said one end of said rotary cylinder valve (3) for gas seal, said cylinder head (47*a*) being secured to said engine block (1).

3. A rotary sleeve-valve internal combustion engine according to any one of claims 1, and 2 further comprising spring exhaust means for discharging the exhaust gas remaining in said rotary cylinder valve (3) during the exhaust cycle of said piston (P) by the spring pressure of a spring (34) that is interposed between said piston (P) and said connecting rod (30) that connects together said piston (P) and said crankshaft (20).

4. A rotary sleeve-valve internal combustion engine comprising:

a. an engine block (1);

b. an inlet port (10) provided in said engine block (1) to suck in a fuel mixture;

c. an exhaust port (15) provided in said engine block (1) to discharge the fuel mixture;

d. a cylindrical rotary cylinder valve (3) rotatably supported in said engine block (1), said valve (3) being hermetically sealed at one end thereof and opened at the other end and having a cylindrical space therein;

e. an opening (5) provided in the outer peripheral wall surface of said rotary cylinder valve (3) to communicate with said inlet port (10) during admission and with said exhaust port (15) during exhaust;

f. a gear (4) provided on said other end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4); and j. spring exhaust means for discharging the exhaust gas remaining in said rotary cylinder valve during the exhaust cycle of said piston by the spring pressure of a spring that is interposed between the piston and the connecting rod that connects together with said piston and said crankshaft;

wherein said spring exhaust means is provided with stoppers (35) and (36) which prevent a piston body (33) constituting said piston (P) from moving in excess of a predetermined distance against said spring (34).

5. A rotary sleeve-valve internal combustion engine comprising:

a. an engine block (1);

b. an inlet port (10) provided in said engine block (1) to suck in a fuel mixture;

c. an exhaust port (15) provided in said engine block (1) to discharge the fuel mixture;

d. a cylindrical rotary cylinder valve (3) rotatably supported in said engine block (1), said valve (3) being hermetically sealed at one end thereof and opened at the other end and having a cylindrical space therein;

e. an opening (5) provided in the outer peripheral wall surface of said rotary cylinder valve (3) to communicate with said inlet port (1) during admission and with said exhaust port (15) during exhaust;

f. a gear (4) provided on said other end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4); and j. an upper piston (50) secured to said engine block (1) through a spring (66) so as to be movable only in the axial direction of said rotary cylinder valve (3), said upper piston (50) being inserted into said rotary cylinder valve (3).

6. A rotary sleeve-valve internal combustion engine comprising:

a. an engine block (1);

b. an inlet port (10) provided in said engine block (1) to suck in a fuel mixture;

c. an exhaust port (15) provided in said engine block (1) to discharge the fuel mixture;

d. a cylindrical rotary cylinder valve (3) rotatably supported in said engine block (1), said valve (3) being hermetically sealed at one end thereof and opened at the other end and having a cylindrical space therein;

e. an opening (5) provided in the outer peripheral wall surface of said rotary cylinder valve (3) to communicate with said inlet port (10) during admission and with said exhaust port (15) during exhaust;

f. a gear (4) provided on said other end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4); and j. an upper piston (50) disposed between said rotary cylinder valve (3) and said engine block (1), said upper piston (50) being provided with a spring (87) and a bearing (86) so as to be rotatable and movable in the axial direction of said rotary cylinder valve (3).

7. A rotary sleeve-valve internal combustion engine according to clam 5 or 6, wherein said upper piston (P) has a stopper surface (67) to prevent said upper piston (P) from moving in excess of a predetermined distance against said spring (66).

8. A rotary sleeve-valve internal combustion engine according to any one of claim 5, 6 or 7, further comprising an annular seal ring (40) disposed around said opening (5) to be in contact with the inner peripheral wall surface (7) of said engine block (1) in order to effect gas seal for said inlet port (10) and said exhaust port (15).

9. An opposed-piston type rotary sleeve-valve internal combustion engine comprising:

a. an engine block (1);
b. an inlet port (10) provided in said engine block (1) to such in a fuel mixture;
c. an exhaust port (15) provided in said engine block (1) to discharge exhaust gas;
d. a rotary cylinder valve (3) rotatably supported by at least one bearing in said engine block (1), said valve (3) being opened at both ends and having a cylindrical space therein;
e. an opening (5) provided in the outer peripheral wall surface of said rotary cylinder valve (3) to communicate with said inlet port (10) during admission and with said exhaust port (15) during exhaust;
f. gears (4) provided on both ends, respectively, of said rotary cylinder valve (3);
g. two pistons ($P_1$) and ($P_2$) slidably fitted in said cylindrical space in said rotary cylinder valve (3) in such a manner as to face each other across said opening (5);
h. two crankshafts (20) connected to said two pistons ($P_1$) and ($P_2$) through two connecting rods (30), respectively; and
i. crank gears (26) provided on said two crankshafts (20) in mesh with said gears (4), respectively.

10. A rotary sleeve-valve internal combustion engine according to claim 9, further comprising an annular seal ring (40) disposed around said opening (5), said seal ring being pushed by centrifugal force produced by rotation of said rotary cylinder valve to come in contact with the inner peripheral wall surface (7) of said engine block (1) in order to effect gas seal for said inlet port (15) and said exhaust port (15).

11. A rotary sleeve-valve internal combustion engine comprising:

a. an engine block (1);
b. an inlet port (10) provided in said engine block (1) to suck in a fuel mixture;
c. an exhaust port (15) provided in said engine block (1) to discharge the fuel mixture;
d. a cylindrical rotary cylinder valve (3) rotatably supported in said engine block (1), said valve (3) being hermetically sealed at one end thereof and opened at the other end and having a cylindrical space therein;
e. an opening (5) provided in the outer peripheral wall surface of said rotary cylinder valve (3) to communicate with said inlet port (1) during admission and with said exhaust port (15) during exhaust;
f. a gear (4) provided on said other end of said rotary cylinder valve (3);
g. a piston (P) slidably fitted in said cylindrical space in said rotary cylinder valve (3);
h. a crankshaft (20) connected to said piston (P) through a connecting rod (30);
i. a crank gear (26) provided on said crankshaft (20) to e in mesh with said gear (4);
j. a cylinder head (47) formed at said one end of said rotary cylinder valve as an integral part thereof for gas seal, and
k. spring exhaust means for discharging the exhaust gas remaining in said rotary cylinder valve during the exhaust cycle of said piston (P) by the spring pressure of a spring (34) that is interposed between said piston (P) and said connecting rod (30) that connects together said piston and said crankshaft, wherein said spring exhaust means is provided with stoppers (35, 36) which prevent a piston body (33) constituting said piston (P) from moving in excess of a predetermined distance against said spring (34).

12. A rotary sleeve-valve internal combustion engine comprising:

a. an engine block (1);
b. an inlet port (10) provided in said engine block (1) to suck in a fuel mixture;
c. an exhaust port (15) provided in said engine block (1) to discharge the fuel mixture;
d. a cylindrical rotary cylinder valve (3) rotatably supported in said engine block (1), said valve (3) being hermetically sealed at one end thereof and opened at the other end and having a cylindrical space therein;
e. an opening (5) provided in the outer peripheral wall surface of said rotary cylinder valve (3) to communicate with said inlet port (10) during admission and with said exhaust port (15) during exhaust;
f. a gear (4) provided on said other end of said rotary cylinder valve (3);
g. a piston (P) slidably fitted in said cylindrical space in said rotary cylinder valve (3);
h. a crankshaft (20) connected to said piston (P) through a connecting rod (30);
i. a crank gear (26) provided on said crankshaft (20) to be in mesh with said gear (4);
j. a cylinder head (47*a*) inserted into said one end of said rotary cylinder valve (3) for gas seal, said cylinder head (47*a*) being secured to said engine block (1); and
k. spring exhaust means for discharging the exhaust gas remaining in said rotary cylinder valve during the exhaust cycle of said piston (P) by the spring pressure of a spring (34) that is interposed between said piston (P) and said connecting rod (30) that connects together said piston and said crankshaft, wherein said spring exhaust means is provided with stoppers (35, 36) which prevent a piston body (33) constituting said piston (P) from moving in excess of a predetermined distance against said spring (345).

13. A rotary sleeve-valve internal combustion engine comprising:

a. an engine block (1);
b. an inlet port (10) provided in said engine (1) to suck in a fuel mixture;
c. an exhaust port (15) provided in said engine block (1) to discharge the fuel mixture;
d. a cylindrical rotary cylinder valve (3) rotatably supported in said engine block (1), said valve (3) being hermetically sealed at one end thereof and opened at the other end and having a cylindrical space therein;
e. an opening (5) provided in the outer peripheral wall surface of said rotary cylinder valve (3) to communicate with said inlet port (10) during admission and with said exhaust port (15) during exhaust;

f. a gear (4) provided on said other end of said rotary cylinder valve (3);

g. a piston (P) slidably fitted in said cylindrical space in said rotary cylinder valve (3);

h. a crankshaft (20) connected to said piston (P) through a connecting rod (30);

i. a crank gear (26) provided on said crankshaft (20) to be in mesh with said gear (4); and j. an annular seal ring (40) disposed around said opening (5) to be in contact with the inner peripheral wall surface (7) of said engine block (1) in order to effect gas seal for said inlet port (10) and said exhaust port (15); and k. spring exhaust means for discharging the exhaust gas remaining in said rotary cylinder valve during the exhaust cycle of said piston (P) by the spring pressure of a spring (34) that is interposed between said piston (P) and said connecting rod (30) that connects together said piston and said crankshaft, wherein said spring exhaust means is provided with stoppers (35, 36) which prevent a piston body (33) constituting said piston (P) from moving in excess of a predetermined distance against said spring (34).

* * * * *